US011101571B2

(12) United States Patent
Kwak et al.

(10) Patent No.: US 11,101,571 B2
(45) Date of Patent: Aug. 24, 2021

(54) ANTENNA DEVICE HAVING CIRCULAR ARRAY STRUCTURE

(71) Applicant: ACE TECHNOLOGIES CORPORATION, Incheon (KR)

(72) Inventors: Byung Hwa Kwak, Incheon (KR); Sang Woo Lee, Goyang-si (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 16/787,314

(22) Filed: Feb. 11, 2020

(65) Prior Publication Data

US 2020/0287296 A1 Sep. 10, 2020

(30) Foreign Application Priority Data

Feb. 18, 2019 (KR) ..... 10-2019-0018542

(51) Int. Cl.

| | |
|---|---|
| ***H01Q 21/20*** | (2006.01) |
| ***H01Q 15/14*** | (2006.01) |
| *H01Q 1/24* | (2006.01) |
| *H01Q 1/48* | (2006.01) |

(52) U.S. Cl.

CPC ..... *H01Q 21/205* (2013.01); *H01Q 15/14* (2013.01); *H01Q 1/246* (2013.01); *H01Q 1/48* (2013.01)

(58) Field of Classification Search

CPC ..... H01Q 21/205; H01Q 15/14; H01Q 1/246; H01Q 1/48

USPC ..... 343/836

See application file for complete search history.

(56) References Cited

U.S. PATENT DOCUMENTS

| | | | | |
|---|---|---|---|---|
| 6,114,999 | A * | 9/2000 | Cassel | H01Q 1/242 343/702 |
| 2010/0253351 | A1* | 10/2010 | Huish | G01R 33/3692 324/318 |
| 2013/0093641 | A1* | 4/2013 | Ng | H01Q 1/521 343/841 |
| 2019/0288406 | A1* | 9/2019 | Yang | H01Q 1/52 |

FOREIGN PATENT DOCUMENTS

| | | | |
|---|---|---|---|
| KR | 10-2002-0028751 | A | 4/2002 |
| KR | 10-2010-0109761 | A | 10/2010 |
| KR | 10-2013-0134793 | A | 12/2013 |

* cited by examiner

*Primary Examiner* — Peguy Jean Pierre

(57) ABSTRACT

An antenna device having a circular array structure is disclosed. The disclosed device may include a multiple number of antennas positioned in a circular array and an upper board joined above the plurality of antennas, where each of the multiple antennas may include a reflector plate and at least one radiator joined to the reflector plate, and at least one FPCB joined to the reflector plates of a first antenna and a second antenna adjacent to each other from among the multiple antennas may further be included. The disclosed device can alleviate the performance degradation incurred by narrow reflector plates in an antenna device having a circular array structure and can provide radiation properties tantamount to essentially expanding the reflector plate of each antenna in an antenna device having a circular array structure.

10 Claims, 6 Drawing Sheets

[Fig.1]
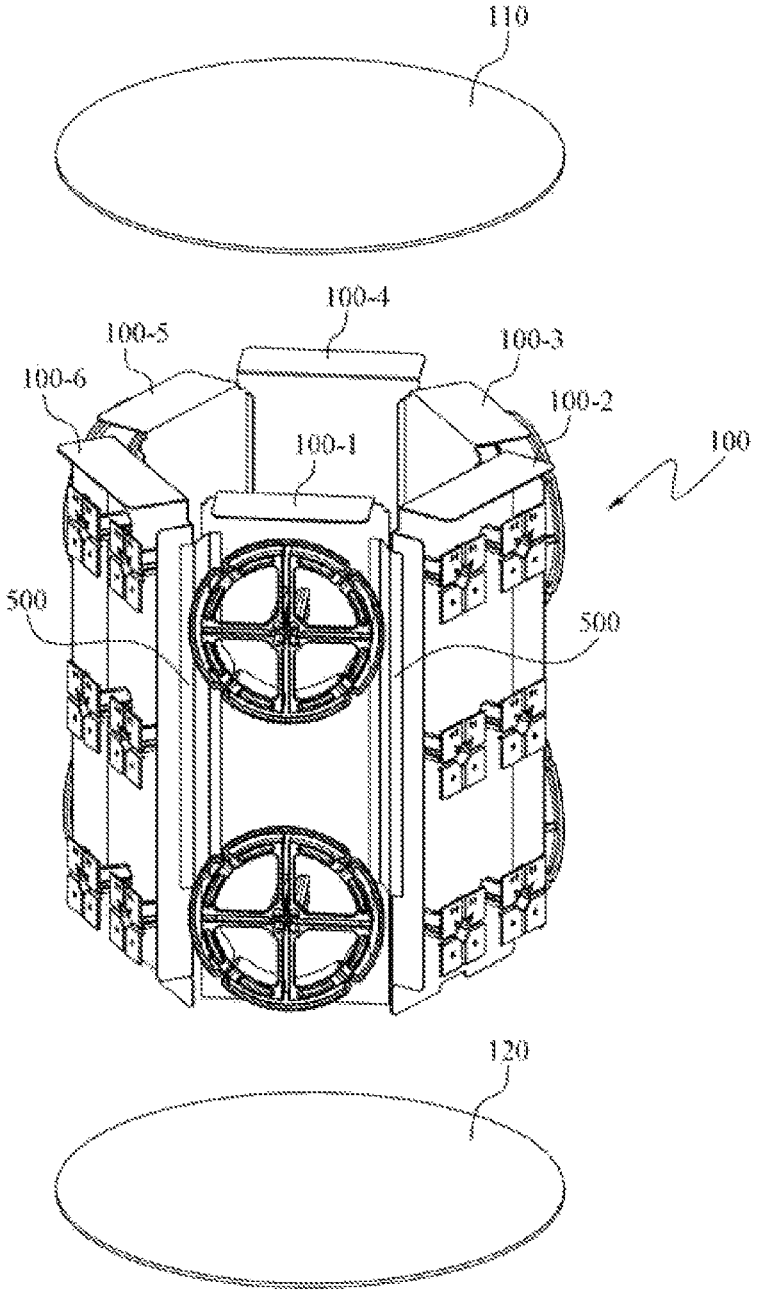

[Fig.2]
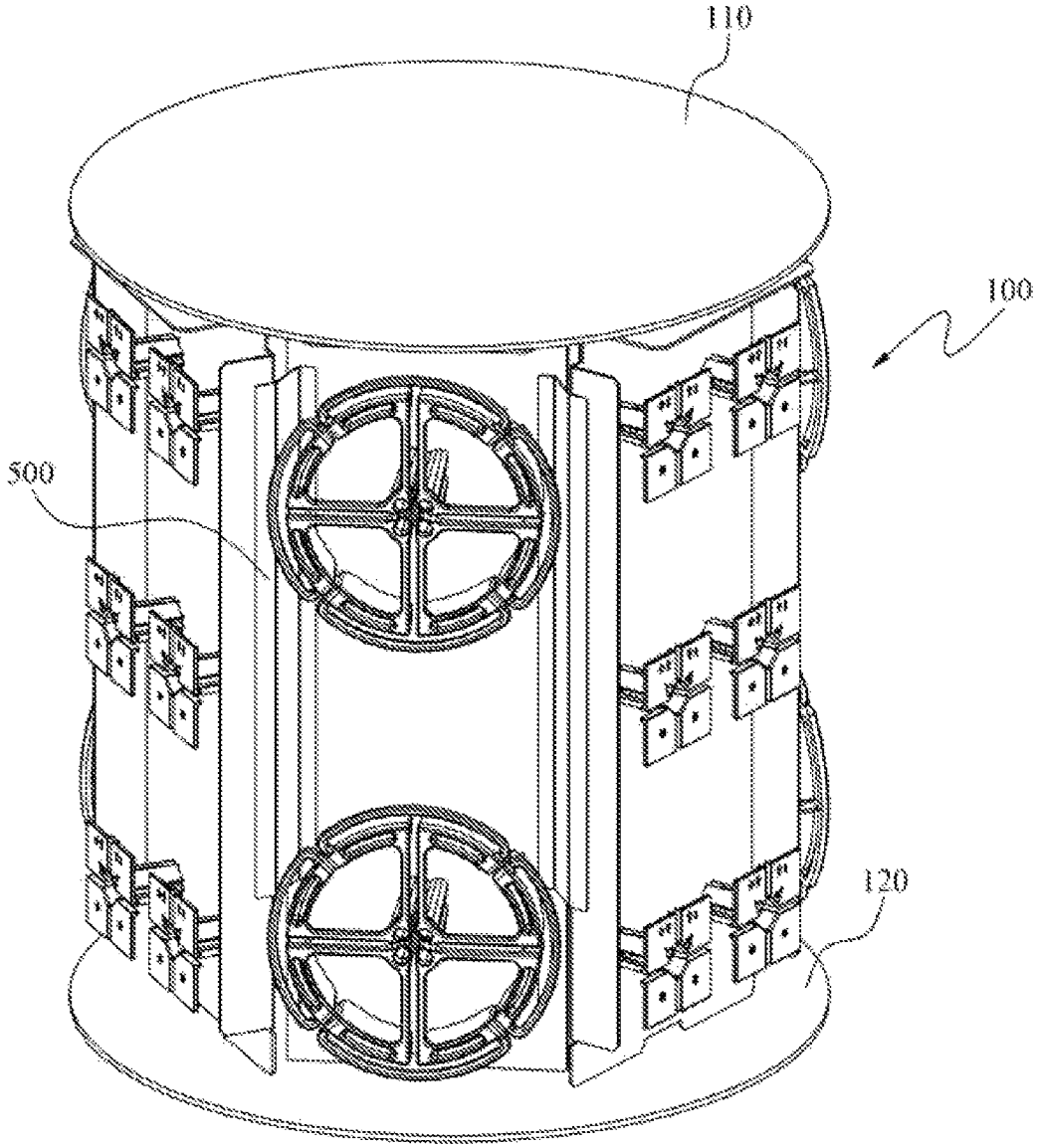

[Fig.3]
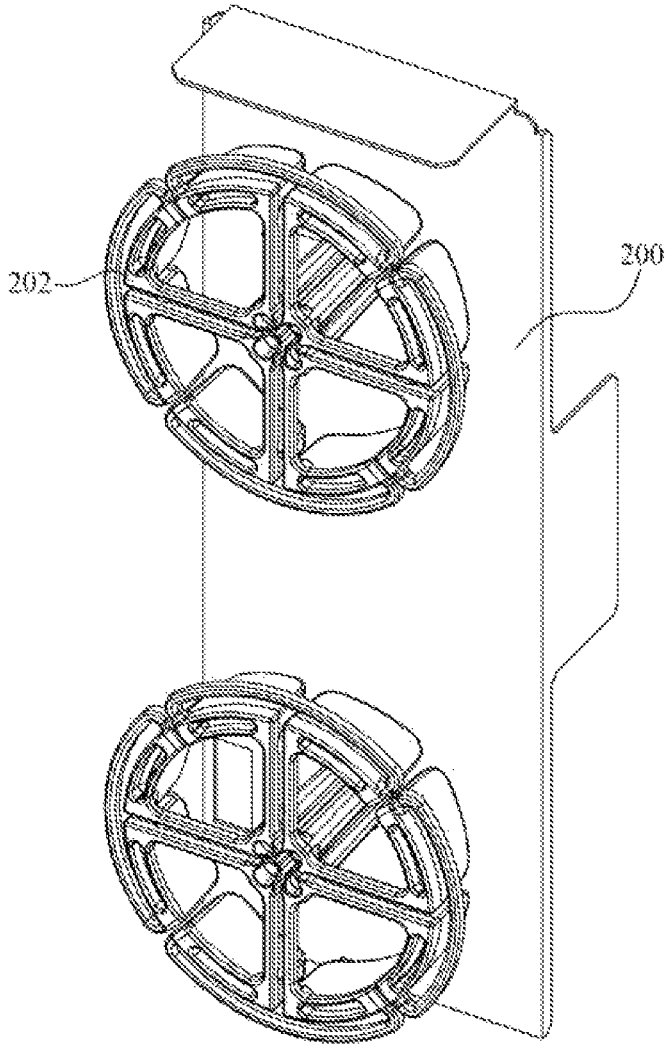

[Fig.4]
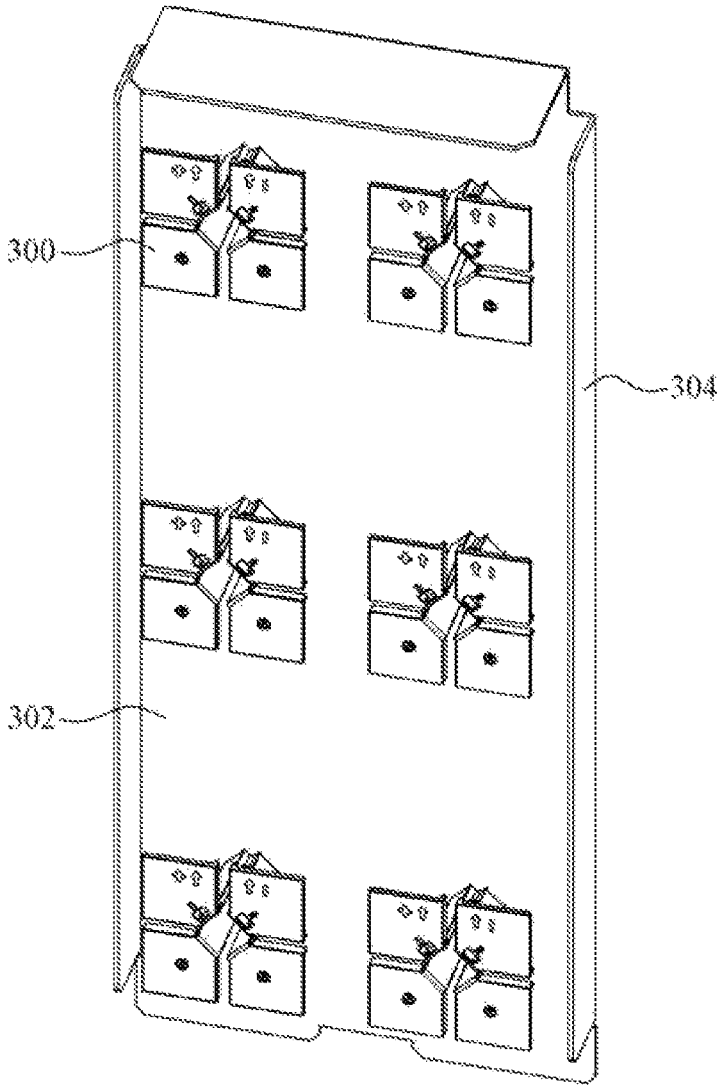

[Fig.5]
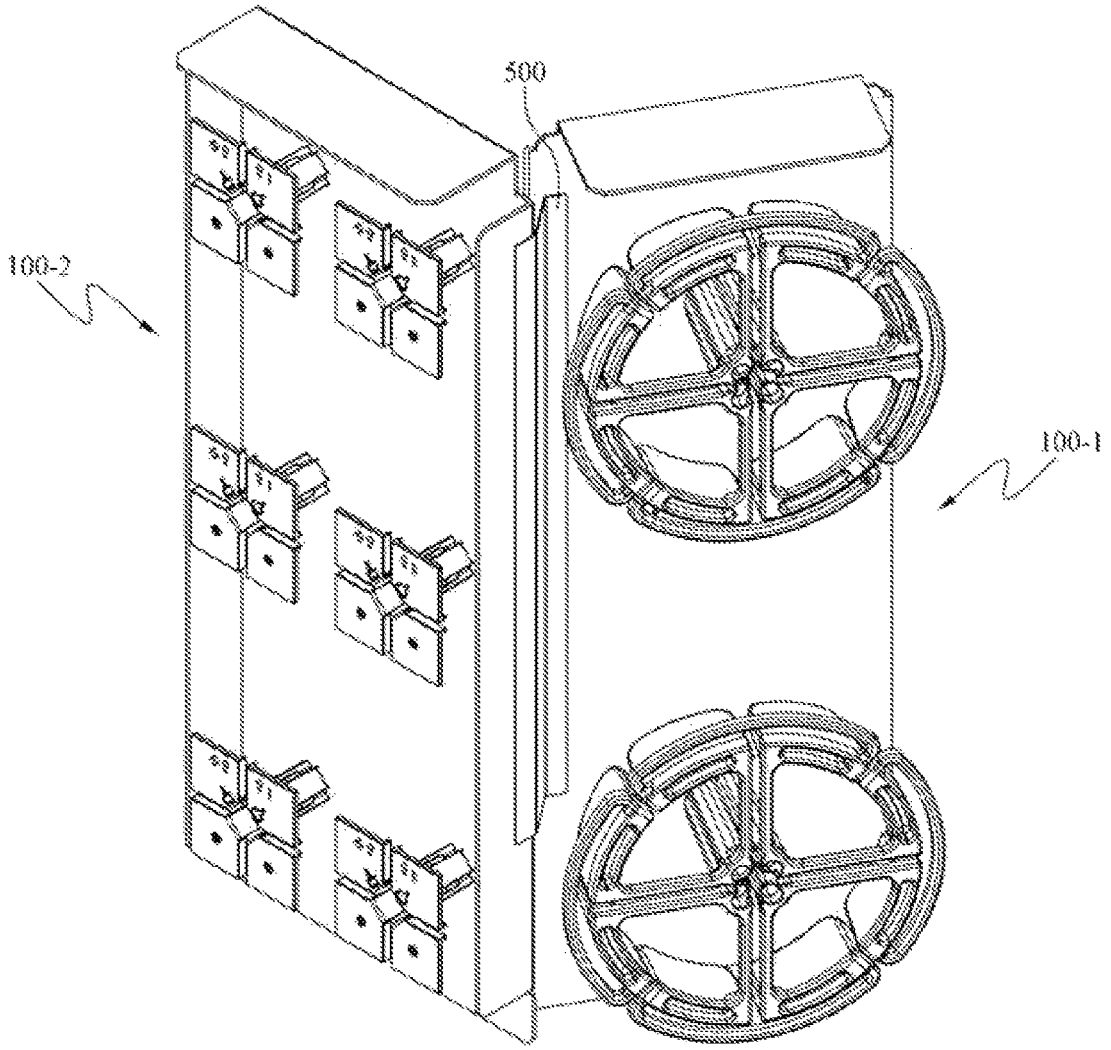

[Fig.6]
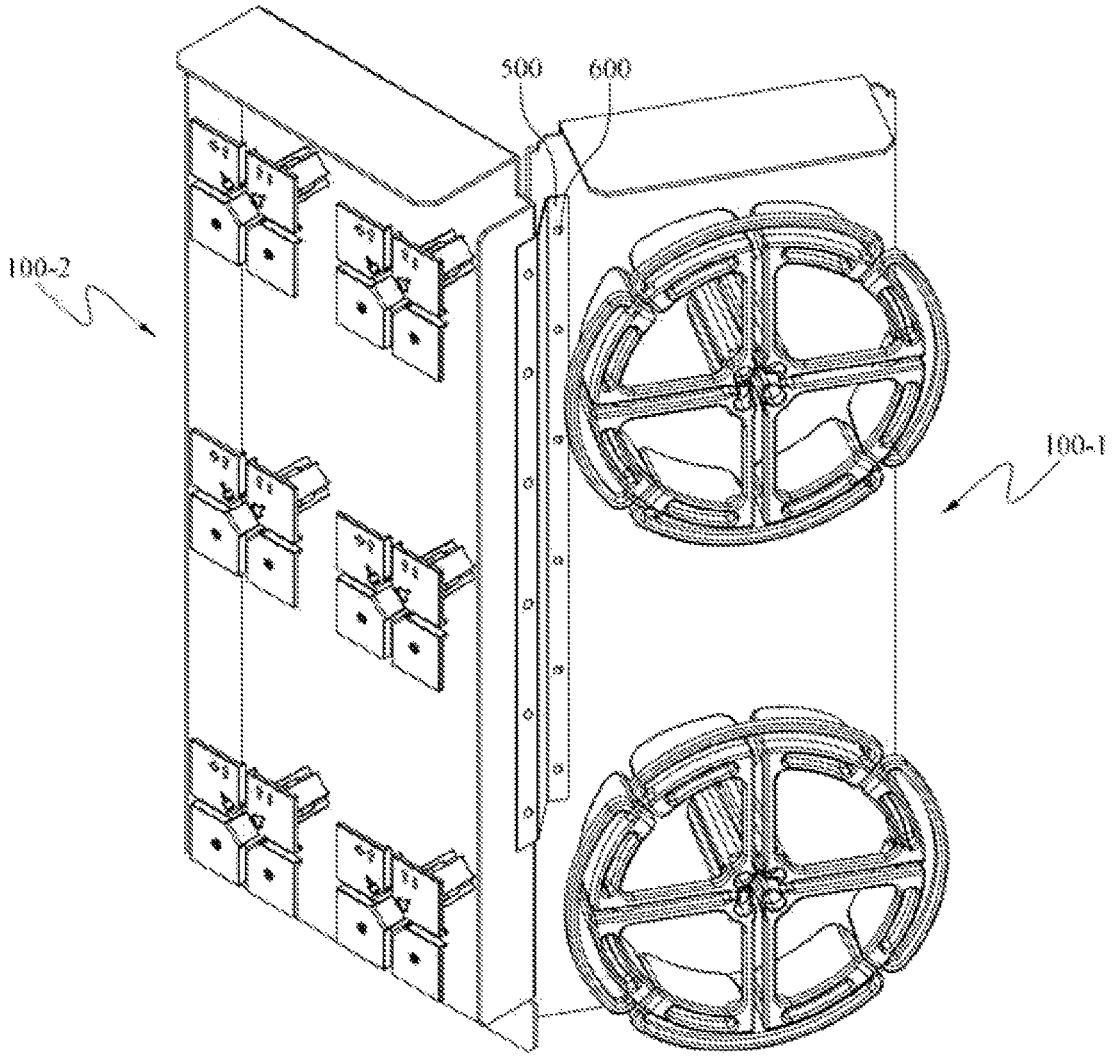

ANTENNA DEVICE HAVING CIRCULAR ARRAY STRUCTURE

CROSS-REFERENCE TO RELATED APPLICATIONS

This application claims priority under 35 U.S.C. § 119(a) to the Korean Patent Application No. 10-2019-0018542, filed with the Korean Intellectual Property Office on Feb. 18, 2019, the disclosure of which is incorporated herein by reference in its entirety.

BACKGROUND

1. Technical Field

The present disclosure relates to an antenna device, more particularly to an antenna device having a circular array structure for a base station or a relay antenna.

2. Description of the Related Art

An antenna is a device for emitting or receiving RF signals and is an essential device for the base station of a mobile communication system as well as the multiple terminals and repeaters communicating with the base station.

An antenna for a base station must be able to provide signals to all areas around the base station and thus must necessarily provide the property of omnidirectionality. In order that good performance may be ensured in all directions, an antenna device is being used in which multiple antennas having radiators are positioned perpendicularly to the ground surface in a circular array and an upper board is separately installed over the multiple antennas to provide feed signals.

An antenna device having a circular array structure is structured such that each antenna has at least one radiator installed on a reflector plate. Also, in an antenna device having a circular array structure, at least five or six antennas may be placed in a circular array, and since multiple antennas are arranged in this manner, there is a limit to the size that the reflector plate of each antenna can have.

The radiator of an antenna requires a ground size of $\lambda/4$ or more of the minimum radiation frequency at the perimeter of the component. Thus, whereas the reflector plate providing the ground potential requires a size of at least $\lambda/4$ or more with respect to the radiator, it may be difficult to provide such size for the reflector plate in a circular array antenna in which multiple antennas are arranged.

Due to an insufficient size of the reflector plate, an antenna device having a circular array structure according to the related art may also entail degradations in terms of reflection loss and isolation characteristics, making it difficult to provide adequate radiation properties.

SUMMARY

An objective of the disclosure is to provide an antenna device that alleviates the performance degradation incurred by narrow reflector plates in an antenna device having a circular array structure.

Another objective of the disclosure is to provide an antenna device that provides radiation properties tantamount to essentially expanding the reflector plate of each antenna in an antenna device having a circular array structure.

One aspect of the disclosure provides a circular array antenna device that includes a multiple number of antennas positioned in a circular array and an upper board joined above the multiple antennas, where each of the multiple antennas includes a reflector plate and at least one radiator joined to the reflector plate, and at least one flexible printed circuit board (FPCB) joined to the reflector plates of a first antenna and a second antenna adjacent to each other from among the multiple antennas is further included.

The FPCB may include a metal surface and a PSR (photoimageable solder resist) layer over the metal surface, and the PSR layer may be joined to the reflector plate of the first antenna and the reflector plate of the second antenna.

A choke member may be formed on either one of the reflector plate of the first antenna and the reflector plate of the second antenna, and the FPCB may be joined to the choke member.

The FPCB may be joined to the reflector plates of the first antenna and the second antenna by using a plastic rivet.

A feed line for providing a radiator feed signal of each of the multiple antennas and a grounding surface for providing a ground potential to the reflector plate of each of the multiple antennas may be formed on the upper board.

An embodiment of the disclosure can alleviate the performance degradation incurred by narrow reflector plates in an antenna device having a circular array structure and can provide radiation properties tantamount to essentially expanding the reflector plate of each antenna in an antenna device having a circular array structure.

BRIEF DESCRIPTION OF THE DRAWINGS

FIG. 1 is an exploded perspective view of an antenna device according to an embodiment of the disclosure.

FIG. 2 is a perspective view of an antenna device according to an embodiment of the disclosure.

FIG. 3 shows an example of an antenna included in an antenna device according to an embodiment of the disclosure.

FIG. 4 shows another example of an antenna included in an antenna device according to an embodiment of the disclosure.

FIG. 5 shows a reflector plate connection structure between adjacent antennas using a flexible printed circuit board (FPCB) according to a preferred embodiment of the disclosure.

FIG. 6 shows an example of joining a reflection plate and a flexible printed circuit board (FPCB) according to a preferred embodiment of the disclosure.

DETAILED DESCRIPTION

A sufficient understanding of the invention, the advantages derived from the operation of the invention, and the objectives achieved by the practicing of the invention requires a referencing of the accompanying drawings, which illustrate a preferred embodiment of the disclosure, as well as the descriptions disclosed in the drawings.

The present disclosure is described below in more detail based on an explanation of a preferred embodiment of the disclosure. However, the disclosure can be implemented in many different forms and is not limited to the embodiment described herein. Also, for a clear understanding of the disclosure, parts that are not of great relevance to the explanation have been omitted. In the drawings, like reference numerals refer to like components.

Throughout the specification, when a part is referred to as "including" a certain element, this does not preclude the presence of other elements and can mean that other elements may further be included, unless there is specific mention to the contrary. Also, terms such as "unit", "device", "module", "block", etc., refer to units for processing at least one function or operation, where such units can be implemented as hardware or software or a combination of hardware and software.

Before a description of the invention, there is first provided a description of the structure of a typical dipole antenna.

FIG. 1 is an exploded perspective view of an antenna device according to an embodiment of the disclosure, and FIG. 2 is a perspective view of an antenna device according to an embodiment of the disclosure.

Referring to FIG. 1 and FIG. 2, an antenna device according to an embodiment of the disclosure may include a multiple number of antennas 100, an upper board 110, and a lower plate 120.

An antenna device according to an embodiment of the disclosure may be structured to have multiple antennas 100 arranged circularly. The number of circularly arranged antennas can be set freely, and FIG. 1 illustrates an example in which there are six antennas positioned in a circular array.

The types of antennas 100 arranged can also be set freely. For instance, the arranged antennas can all be of the same type of antenna. Alternatively, certain antennas can be antennas for radiating a first band, while other antennas can be antennas for a second band.

In a structure where multiple antennas are arranged circularly as in FIG. 1 and FIG. 2, two or three different types of antennas are generally used. For example, the first, third, and fifth antennas 100-1, 100-3, 100-5 can be antennas for radiating a first band, and the second, fourth, and sixth antennas 100-2, 100-4, 100-6 can be antennas for radiating a second band.

In cases where two types of antennas are used as above, the first, third, and fifth antennas 100-1, 100-3, 100-5 can radiate signals for 120-degree areas in their respective forward directions to provide 360-degree radiation for the first band, and the second, fourth, and sixth antennas 100-2, 100-4, 100-6 can radiate signals for 120-degree areas in their respective forward directions to provide 360-degree radiation for the second band.

When two types of antennas are used as above, the two other antennas adjacent to a particular antenna may be of a different type. For example, the first antenna 100-1, which radiates the first band, may be positioned adjacent to the second antenna 100-2 and sixth antenna 100-6, which radiate the second band.

A circular array antenna such as that illustrated in FIG. 1 is structured to have multiple antennas arranged in dense intervals, so that the antennas cannot have large widths. In particular, a structure having five or more antennas arranged densely would inevitably be limited in width.

FIG. 3 shows an example of an antenna included in an antenna device according to an embodiment of the disclosure.

Referring to FIG. 3, an antenna forming an antenna device based on the present disclosure may include a reflector plate 200 and multiple radiators 202. The antenna illustrated in FIG. 3 can be an antenna for radiating a first band (i.e. the first antenna, third antenna, and fifth antenna).

The reflector plate 200 may be made of a metallic material and electrically may have a ground potential. The reflector plate 200 may enable the RF signals emitted from the radiator 202 to be radiated in the opposite direction of the reflector plate.

The multiple radiators 202 may be provided with feed signals to radiate RF signals to the outside or may receive RF signals. Although FIG. 3 illustrates an example in which multiple radiators 202 are arranged on a reflector plate 200, it is possible to have just one radiator present.

Feed lines for providing feed signals to the radiators 202 and a grounding surface for providing the ground potential to the reflector plate 200 can be formed on the upper board 110.

FIG. 4 shows another example of an antenna included in an antenna device according to an embodiment of the disclosure. The antenna illustrated in FIG. 4 can be an antenna for radiating a second band (i.e. the second antenna, fourth antenna, and sixth antenna). Referring to FIG. 4, an antenna for radiating a second band can include a reflector plate 302, multiple radiators 300, and choke members 304.

The functions of the reflector plate 302 and the multiple radiators 300 may be the same as those of the antenna for radiating the first band illustrated in FIG. 3. However, the forms of the radiators 300 are different from those of the radiators 202 for radiating the first band, where the forms and sizes may be different because the radiation bands are different.

An antenna for radiating the second band can include choke members 304, unlike the antenna for radiating the first band. The choke members 304 may be formed perpendicularly to the reflector plate 302 at both side portions of the reflector plate 302.

Choke members 304 may be formed when there is a need to improve the front-to-back ratio of the antenna. While the height of the choke members 304 can be deter-mined based on the front-to-back ratio, it may be preferable that the height be lower than the height of the radiators 300.

The choke members 304 can be structured to form an integrated body with the reflector plate 302, in which case the choke members 304 can be formed by folding the side portions of the reflector plate 302. Alternatively, it would also be possible to form the choke members 304 by joining members that are separate from the reflector plate 302 onto the reflector plate 302. Of course, the choke members 304 can be formed on both the first and the second antenna.

Referring again to FIG. 1 and FIG. 2, the feed lines and grounding surface for providing the feed signals and the ground potential to the multiple antennas may be formed on the upper board 110, but the feed lines formed on the upper board 110 are not illustrated in the drawings, as these are not part of the essence of the disclosure.

The feed lines for providing feed signals to each of the multiple antennas can be formed on an upper portion of the upper board 110, where the feed lines can be implemented for example in the form of metal patterns. The grounding surface can be formed on a lower portion of the upper board 110, where the grounding surface can be formed over the entire area of the lower portion of the upper board 110.

Each of the multiple antennas 100 can be joined with the upper board 110 and adjusted, and the electrical junctions with the feed lines and grounding surface can be formed at the joint portions between the upper board 110 and the multiple antennas 100.

The upper board 110 can be, for example, a PCB (printed circuit board), but the disclosure is not limited thus.

The lower plate 120 may function as a base for an antenna according to an embodiment of the disclosure. Each of the multiple antennas 100 may be joined with the lower plate 120. It would also be possible to form electrical or RF circuits on the lower plate 120 as necessary.

As described above, when multiple antennas 100 are arranged circularly, the size of the reflector plate is inevitably limited, and the width of the reflector plate in particular is inevitably narrowed.

An array antenna using multiple radiators as illustrated in FIG. 3 and FIG. 4 can only realize adequate radiation if a sufficient ground size is provided. If a sufficient ground size is not provided, degradations in reflection loss properties and interport isolation characteristics may prevent adequate radiation.

Previous attempts to resolve this problem have adopted a structure for physically connecting the reflector plates between adjacent antennas. However, physically connecting adjacent antennas would use metal members for the physical connections, but connecting two reflector plates with a metal member would unavoidably cause degradations in PIMD performance due to contact between metals.

Also, the improvements in radiation performance provided by the method of physically connecting the reflector plates of adjacent antennas were extremely small, as simply connecting the reflector plates physically does not actually increase the ground size.

An embodiment of the present disclosure uses a flexible printed circuit board (FPCB) to resolve the structural problem posed by the circular array antenna.

FIG. 5 shows a reflector plate connection structure between adjacent antennas using a flexible printed circuit board (FPCB) according to a preferred embodiment of the disclosure.

FIG. 5 illustrates a structure for connecting a first antenna 100-1 and a second antenna 100-2 adjacent to each other by using a flexible printed circuit board (FPCB) 500. As is known, a flexible printed circuit board (FPCB) is a board having a flexible quality.

The FPCB 500 may be joined to the reflector plate of the first antenna 100-1 and the reflector plate of the second antenna 100-2. A flexible printed circuit board (FPCB) according to a preferred embodiment of the disclosure may include a metal surface, and a PSR layer by PSR (photoimageable solder resist) treatment may be present over the metal surface.

The reflector plates and the FPCB may be joined together such that the PSR layer of the FPCB contacts the reflector plate of the first antenna 100-1 and the reflector plate of the second antenna 100-2. That is, there is no direct contact between the metal surface of the FPCB and the reflector plates.

Such a joint structure means that the metal surface of the FPCB and the reflector plate are joined by an RF coupling method and that performance degradations from PIMD can be prevented, since there is no direct contact between metal and metal. Thus, a coupling connection between the first antenna reflector plate and the FPCB and a coupling connection between the second antenna reflector plate and the FPCB essentially provides a connection structure that connects the first antenna reflector plate, the FPCB metal surface, and the second antenna reflector plate.

Also, the addition of the metal surface of the FPCB can provide an effect of essentially expanding the ground, unlike existing methods, and significant improvements over existing methods in terms of reflection loss properties and isolation characteristics can be obtained as well.

Furthermore, the flexible quality of the FPCB makes it possible to use a FPCB having a comparatively broader metal surface even in narrow spaces.

In FIG. 1, an example is illustrated in which the FPCB is joined to the reflector plate in the first antenna 100-1 but joined to the choke member 304 in the second antenna 100-2. In cases where choke members are formed on the reflector plate of one of the two antennas connected by a FPCB, the FPCB can provide greater improvements in radiation properties when joined to a choke member.

The reflector plate connection structure using a FPCB illustrated in FIG. 5 can be applied to all antennas forming a circular array. In other words, not just the first antenna 100-1 and second antenna 100-2 but all of the antennas can be connected by a structure such as that shown in FIG. 5 to implement an effect of essentially expanding the ground.

FIG. 6 shows an example of joining a reflection plate and a flexible printed circuit board (FPCB) according to a preferred embodiment of the disclosure.

While the joining of the FPCB and a reflector plate can be achieved in various ways, it may be preferable that the joining be performed such that its impact on the radiation properties is minimized.

According to a preferred embodiment of the disclosure, the FPCB may be joined to the reflector plate by using a multiple number of plastic rivets 600, as illustrated in FIG. 6. By joining the FPCB to the reflector plate with rivets of a plastic material, it is possible to prevent changes in radiation properties and degradations in PIMD performance otherwise caused by metal.

Of course, it should be apparent to the skilled person that joining methods other than those using plastic rivets, such as bonding, etc., can also be adopted.

While the disclosure is described with reference to the embodiments illustrated in the drawings, these are provided merely as examples, and a person having ordinary skill in the art would appreciate that different variations and equivalent embodiments can be derived.

As such, the true scope of protection for the present disclosure is to be defined by the technical spirit of the appended claims.

What is claimed is:

1. A circular array antenna device comprising:

a plurality of antennas positioned in a circular array;

an upper board joined above the plurality of antennas, wherein each of the plurality of antennas comprises a reflector plate and at least one radiator joined to the reflector plate; and at least one flexible printed circuit board (FPCB) joined to reflector plates of a first antenna and a second antenna from among the plurality of antennas, the first antenna and the second antenna adjacent to each other, wherein a feed line for providing a radiator feed signal of each of the plurality of antennas and a grounding surface for providing a ground potential to the reflector plate of each of the plurality of antennas are formed on the upper board.

2. The circular array antenna device of claim 1, wherein the FPCB comprises a metal surface and a PSR (photoimageable solder resist) layer over the metal surface, and the PSR layer is joined to the reflector plate of the first antenna and the reflector plate of the second antenna.

3. The circular array antenna device of claim 2, wherein a choke member is formed on either one of the reflector plate of the first antenna and the reflector plate of the second antenna, and the FPCB is joined to the choke member.

4. The circular array antenna device of claim 1, wherein the FPCB is joined to the reflector plates of the first antenna and the second antenna by using a plastic rivet.

5. The circular array antenna device of claim 2, wherein the PSR layer of the FPCB directly contacts the reflector plates of the first antenna and the second antenna.

6. The circular array antenna device of claim 5, wherein the metal surface of the FPCB does not directly contact the reflector plates.

7. The circular array antenna device of claim 5, wherein the metal surface of the FPCB and the reflector plates are joined by an RF coupling method.

8. The circular array antenna device of claim 1, wherein the feed line is formed on an upper portion of the upper board and the grounding surface is formed on a lower portion of the upper board.

9. The circular array antenna device of claim 1, wherein the feed line is implemented in a form of metal patterns.

10. The circular array antenna device of claim 1, further comprising a lower plate joined below the plurality of antennas, wherein electrical or RF circuits are formed on the lower plate.

* * * * *